US005499416A

United States Patent [19]

Daouk

[11] Patent Number: 5,499,416

[45] Date of Patent: Mar. 19, 1996

[54] FLOATING STRETCHER DESIGNED, IN PARTICULAR, FOR THE RECOVERY OF INJURED PERSONS AT SEA

[76] Inventor: Antar Daouk, 27, avenue du Maréchal Lyautey, 75016 Paris, France

[21] Appl. No.: 303,206

[22] Filed: Sep. 8, 1994

[30] Foreign Application Priority Data

Sep. 9, 1993 [FR] France ..... 93 10704

[51] Int. Cl.[6] ..... A61G 1/00; A61G 1/013

[52] U.S. Cl. ..... 5/625; 441/83; 441/129

[58] Field of Search ..... 5/625, 627, 628; 441/83, 129

[56] References Cited

U.S. PATENT DOCUMENTS 3,890,659 6/1975 Staubs ..... 5/627

4,621,382 11/1986 Burriss et al. ..... 441/129

4,679,260 7/1987 Frettem ..... 5/627

*Primary Examiner*—Alexander Grosz

*Attorney, Agent, or Firm*—Finnegan, Henderson, Farabow, Garrett & Dunner

[57] ABSTRACT

Floating stretcher, designed, in particular, for recovering injured persons at sea, of the type including a metallic framework (1) capable of being winched by helicopter and supporting a panel of composite material (2) ensuring the buoyancy of the whole, characterized in that the panel of composite material (2) is pivotably fixed to the front of the metallic framework (1) and in that means (25, 34) are provided for maintaining the said panel (2) either in a position inclined at a given angle in relation to the plane of the framework (1) and above the latter, or in the plane of the framework.

8 Claims, 2 Drawing Sheets

FLOATING STRETCHER DESIGNED, IN PARTICULAR, FOR THE RECOVERY OF INJURED PERSONS AT SEA

The present invention relates to a floating stretcher designed, in particular, for the recovery of injured persons at sea, of the type including a metallic framework capable of being winched by a helicopter and supporting a panel made of composite material ensuring the buoyancy of the whole.

U.S. patent application Ser. No. 08/261,953, filed Jun. 17, 1994 in the name of the same Applicant, already described a floating stretcher capable of being winched by a helicopter and having numerous advantages, in particular that of being foldable in order to reduce its overall dimensions during storage and transport. However, it has become apparent in practice that this stretcher might not, under certain circumstances, have a sufficient self-righting torque. Indeed, when the injured person is secured, in the water, to the stretcher, the latter tends to assume a more vertical position owing to the weight of the injured person and there is then a risk of its turning the wrong way round.

The main object of the present invention is to remedy this drawback and, to do so, it provides a stretcher of the aforementioned type which is essentially characterized in that the panel of composite material is pivotably fixed at the front of the metallic framework and in that means are provided for maintaining the said panel either in a position inclined at a given angle in relation to the plane of the framework and above the latter, or in the plane of the framework.

Thus, when the stretcher is in the water and the panel is inclined in relation to the framework, the latter acts after the fashion of a ballasted keel, which gives the stretcher a substantial self-righting torque preventing it from turning the wrong way round, even when a heavy injured person is secured to the stretcher.

In a particular form of embodiment of the invention, the means for maintaining the panel in an inclined position in relation to the framework is constituted by at least one prop folding in two portions, hinging respectively on the panel and on the framework via pins.

Preferably, the hinges of the prop are disposed at the rear of the panel and of the framework, with the prop folding forwards.

In addition, a means is advantageously provided for locking the prop in its extended position.

It is important, in fact, that the prop should not fold up unexpectedly while the stretcher was being used.

According to another aspect of the invention, the means for maintaining the panel in the plane of the framework is constituted by a bolt member slidably mounted on the framework, at the rear of the latter, and coming into engagement with a striking plate member provided on the rear portion of the panel.

Preferably, the bolt member is biassed by a spring in the locking direction and it is designed to engage automatically in the striking plate member when the panel is placed in the plane of the framework.

Thus, when the prop is folded up, just before proceeding to winch the stretcher by helicopter, the panel can be locked swiftly and easily in the plane of the stretcher, even under difficult sea conditions.

According to yet another characteristic of the invention, the system for pivotably fixing the panel to the front of the framework is constituted by a pin cooperating with bearings fixed, respectively, to the panel and to the framework.

Preferably, the pin of the system for pivotably fixing the panel to the front of the framework and the pin for hinging the prop on the said panel are constituted by removable rods.

It is thus possible, as described in U.S. Ser. No. 08/261,953, to detach the panel from the framework in order to take the injured person to an X-ray service without having to transfer him or her to another support means.

One form of embodiment of the invention is described hereinafter by way of example, with reference to the annexed drawings, wherein.

Figure 1:
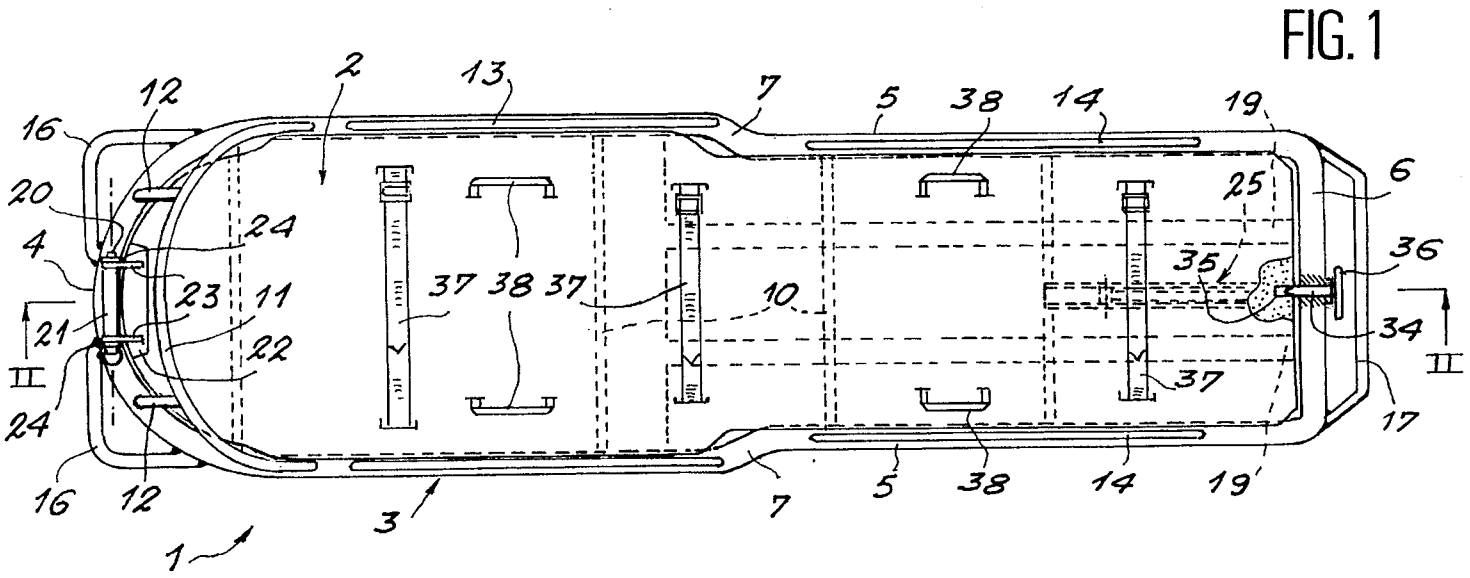
FIG. 1 is a top view of a floating stretcher according to the present invention.
Figure 2:
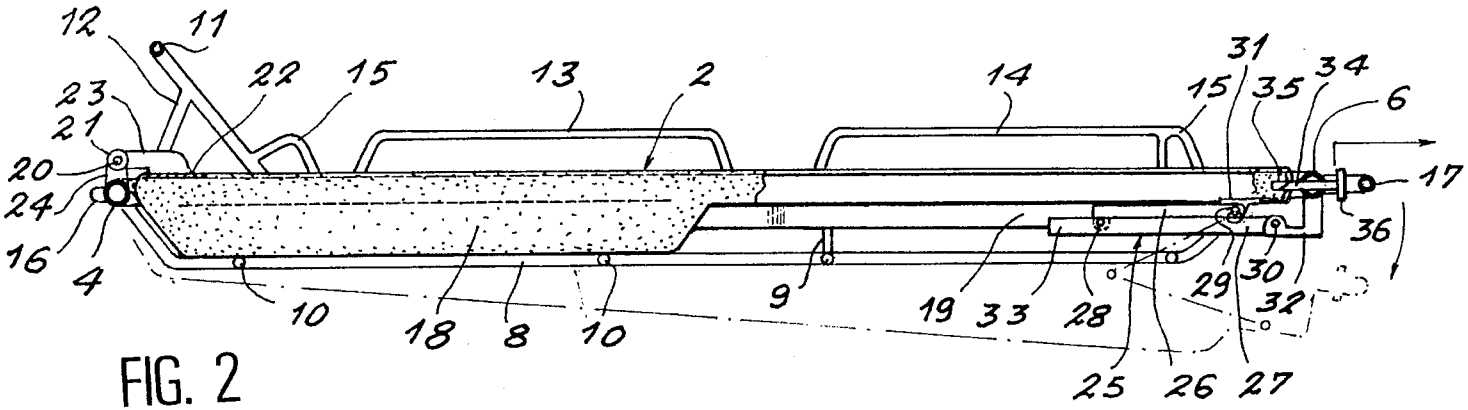
FIG. 2 is a cross-sectional view of the said stretcher along line II—II of FIG. 1.

The stretcher represented in FIGS. 1 and 2 is chiefly composed of a metallic framework 1 supporting a panel 2 of composite material which ensures the buoyancy of the whole. This stretcher is, in fact, designed to accommodate injured persons or shipwrecked persons who have fallen into the sea, in particular the pilots of aircraft. It goes without saying, however, that such a stretcher can also be used in any aquatic environment, lake or river, both by the army and by the civil defence service.

Metallic framework 1 is essentially constituted by a rigid main tube 3 made of stainless steel, bent in the area of the portion surrounding the injured person's head, as represented at 4, and the two limbs 5 of which extend, substantially parallel, to the region of the feet, where the tube is closed by a straight portion 6. It will further be noted that each of limbs 5 has a width increasing section 7 in the median portion, which enables the injured person to be made more comfortable in the region of arms, without excessively increasing the overall dimensions of the stretcher.

The metallic framework 1 is also provided, on its lower portion, with two secondary tubes 8 of smaller diameter, connected to the main tube 3 by junction tubes 9 and which extend parallel thereto along the two limbs 5. The ends of these two tubes 8 are raised and welded to the main tube 3, thus forming two sled runners making it easier to introduce the stretcher inside the rescue helicopter, enabling the winch operator to slide the stretcher over the edge of the cargo hatchway, or inside an ambulance.

The tubes 8 of the sled runners are further connected together by transverse tubes such as 10, which give framework 1 its lateral rigidity. This framework thus has a certain depth permitting accomodation of the panel 2 of composite material designed to support the injured person.

Metallic framework 1 also includes, at the head end, a hoop 11 welded to the main tube 3 and connected to the bent portion 4 thereof by junction tubes 12. This hoop is intended to protect the head or the helmet of the injured person when he or she is transported on the stretcher.

Small tubes 13 and 14 are also welded to the two limbs 5 of the main tube 3 in such a way as to project upwards, thus providing lateral protection in the region of the shoulders and shinbones for the injured person transported.

At the four ends of the stretcher and to main tube 3 are welded ring shaped portions 15 to enable slings to be attached. These rings 15 are disposed in such a way that, when the stretcher is winched by helicopter, the pendant used to make fast the stretcher automatically causes the latter to adopt a position substantially inclined at an angle of 45°. The injured party secured on the panel of composite material 2 thus remains in a relatively stable position.

Finally, tubes are welded to the front of the metallic framework 1, in the region of bent portion 4, so as to form a pair of front handles 16, while a tube is also welded to the rear of the framework, in the region of straight portion 6, so as to form a rear handle 17, which will enable the stretcher to be transported, if necessary, by hand.

As to the panel 2 of composite material, this closely matches the shape of the main tube 3 of framework 1, without projecting outside and is thus perfectly protected against impact. Its upper face is perfectly plane, while its lower face has, at the front, a relatively large bulging portion 18 which is extended rearwards by two parallel longitudinal chevrons 19.

As disclosed in U.S. Ser. No. 08/261,953 this particular form of embodiment enables the stretcher, when thrown into the water, to turn right side up automatically and then to assume a position that is inclined at an angle of approximately 45°, the upper end of the stretcher being approximately 50 cm out of the water. This buoyancy at 45° is guaranteed when the stretcher is equipped with all its accessories required for winching by helicopter, that is to say a pendant and a length of cable approximately 50 meters, the whole weighing approximately 3 kg.

However, it has become apparent in practice that this particular shape of the panel of composite material does not always suffice to maintain the stretcher right side up, particularly when the injured person is secured thereupon.

Figure 3:
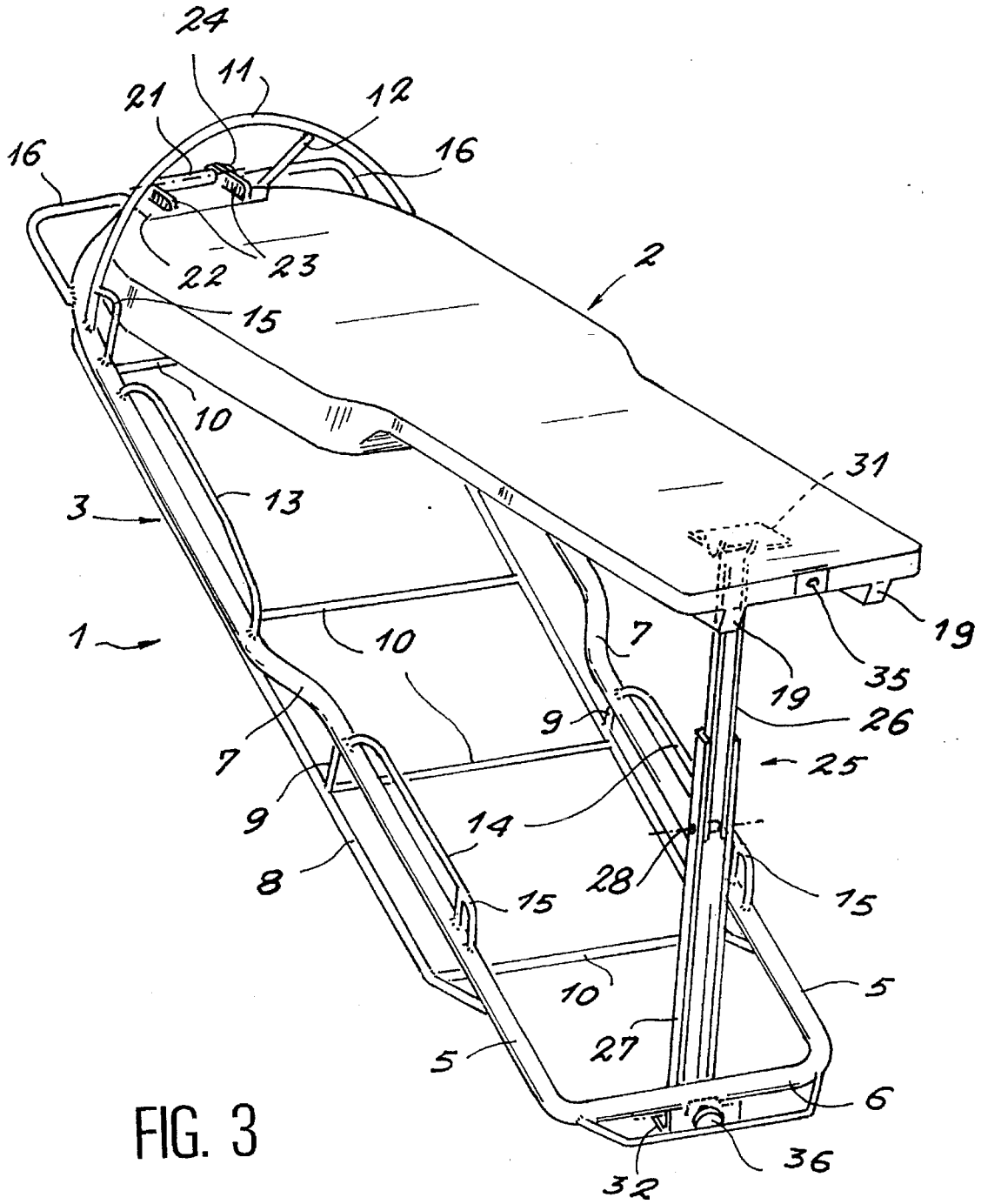
FIG. 3 is a perspective view showing the stretcher when the panel of composite material is maintained in an inclined position above the metallic framework.

That is why, according to the present invention, means are provided for maintaining panel 2 in a position inclined at a given angle in relation to the plane of the framework, for example an angle of between 10° and 30°, as shown in FIG. 3. Thus, when the stretcher is in the water in such a position, the metallic framework 1, which is heavier, acts as a ballasted keel and maintains the stretcher orientated in the correct direction under all circumstances, whatever the weight of the injured person secured to the panel of composite material.

For this purpose, the panel 2 of composite material is pivotally fixed to the front of metallic framework 1 by a pin 20 cooperating with bearings borne respectively by the panel and the framework. In the particular form of embodiment described here, the bearing of the panel is formed by a section of tube 21 welded to a built-on metallic piece 22 by brackets 23, while the bearing of the framework is constituted simply by lugs 24 welded onto the bent portion 4 of the framework on either side of the section of tube 21.

The stretcher is equipped, furthermore, at the rear, with a folding prop 25 in two parts, 26 and 27, hinging upon one another at 28 and the other ends of which are hinged respectively on panel 2 and on framework 1 by means of pins 29 and 30. The said prop 25 is designed to fold forwards and hinge 29 of the panel is provided on a built-on metallic piece 31 fixed to the underside of the panel in the vicinity of its rear end, while hinge 30 of the framework is borne by a mounting 32 welded onto the straight rear portion 6 of the framework.

A means is further provided for locking the prop 25 in its extended position. This means can, for example, be constituted by an extension with a U-shaped section 33 of the lower portion 27 of the prop, into which the upper portion 26 of the prop clips.

Thus, the panel 2 of composite material can be firmly held in its inclined position in relation to metallic framework 1, which ensures the correct stability of the stretcher in the water, even under difficult sea conditions.

To close the stretcher, it suffices to exercise pressure upon the prop in the region of its hinge 28, which is very easy to accomplish, even in the water. Means are then provided to ensure the automatic locking of panel 2 in the plane of the framework 1. These means are formed here by a bolt member 34 mounted slidably in the straight rear portion 6 of the framework and cooperating with a striking plate member 35 provided on the rear end of the panel. Bolt 34, provided with an actuating knob 36, is biassed by a spring, not shown, in the locking direction and it is designed to engage automatically in striking plate 35 thanks to an inclined portion. Thus, it suffices to exert a slight pressure on the panel to ensure that it is locked in the plane of the framework, unlocking being effected by applying traction to the actuating knob 36.

Such a stretcher thus proves very convenient to use for rescue workers, while offering the injured persons added security.

According to another characteristic of the invention, pin 20 of the system for pivotably fixing the panel to the front of the framework, and pin 29 of the hinge of prop 25 on the said panel are formed by removable rods, for example rods mounted on ball bearings. Thus, and as described in U.S. Ser. No. 08/261,953, once the injured person has been rescued and brought to shore, the panel 2 of composite material can easily be detached from framework 1 in order to transport the injured person directly to a suitable X-ray service without having to handle the said person unnecessarily. For this purpose, the panel is provided with straps 37 for securing the injured person thereto independently of the framework, and with four flexible carrying handles 38.

It goes without saying, moreover, that such a stretcher could also be designed to be foldable, as disclosed in U.S. Ser. No. 08/261,953, or to be simply dismountable.

I claim:

1. Floating stretcher, designed, in particular, for recovering injured persons at sea, of the type including a metallic framework (1) capable of being winched by helicopter and supporting a panel of composite material (2) ensuring the buoyancy of the whole, characterized in that the panel of composite material (2) is pivotably fixed to the front of the metallic framework (1) and in that means (25, 34) are provided for maintaining the said panel (2) either in a position inclined at a given angle in relation to the plane of the framework (1) and above the latter, or in the plane of the framework.

2. Floating stretcher according to claim 1, characterized in that the means for maintaining the panel in a position inclined in relation to the framework is constituted by at least one folding prop (25) in two parts (26, 27) hinging respectively on the panel (2) and on the framework (1) via pins (29, 30).

3. Floating stretcher according to claim 2, characterized in that the hinges (29, 30) of the prop (25) are disposed at the rear of the panel (2) and of the framework (1), with the prop (25) folding forwards.

4. Floating stretcher according to claim 1 or 2, characterized in that a means (33) is provided for locking the prop (25) in its extended position.

5. Floating stretcher according to claim 2 characterized in that a pin (20) is provided for pivotably fixing the panel to the front of the framework that cooperates with bearings (21, 24) fixed respectively to the panel (2) and to the framework (1).

6. Floating stretcher according to claim 5, characterized in that the pin (20) for pivotably fixing the panel (2) to the front of the framework (1) and the pin (29) of the hinge of the prop (25) on the said panel (2) are constituted by removable rods.

7. Floating stretcher according to claim 1, characterized in that the means for maintaining the panel in the plane of the framework is constituted by a bolt member (34) mounted slidably in the framework (1) at the rear thereof and coming into engagement with a striking plate member (35) provided on the rear portion of the panel (2).

8. Floating stretcher according to claim 7, characterized in that the bolt member (34) is biassed by a spring in the locking direction and it is designed to engage automatically in the striking plate member (35) when the panel (2) is placed in the plane of the framework (1).

* * * * *